US009422047B1

(12) United States Patent
Camp et al.

(10) Patent No.: US 9,422,047 B1
(45) Date of Patent: Aug. 23, 2016

(54) SYSTEMS AND METHODS FOR FACILITATING SHIFT CHANGES IN MARINE PROPULSION DEVICES

(71) Applicant: Brunswick Corporation, Lake Forest, IL (US)

(72) Inventors: David G. Camp, Fond du Lac, WI (US); Andrew J. Przybyl, Berlin, WI (US)

(73) Assignee: Brunswick Corporation, Lake Forest, IL (US)

( * ) Notice: Subject to any disclaimer, the term of this patent is extended or adjusted under 35 U.S.C. 154(b) by 60 days.

(21) Appl. No.: 14/180,764

(22) Filed: Feb. 14, 2014

Related U.S. Application Data

(60) Provisional application No. 61/782,485, filed on Mar. 14, 2013.

(51) Int. Cl.
*B63H 23/02* (2006.01)

(52) U.S. Cl.
CPC ..... *B63H 23/02* (2013.01)

(58) Field of Classification Search
USPC ..... 701/21, 22; 440/1, 84, 85, 86; 477/109
See application file for complete search history.

(56) References Cited

U.S. PATENT DOCUMENTS 4,257,506 A 3/1981 Bankstahl
4,753,618 A 6/1988 Entringer
4,843,914 A 7/1989 Koike
4,843,915 A 7/1989 Sugimura et al.
4,903,662 A 2/1990 Hirukawa et al.
4,952,181 A 8/1990 Entringer et al.
4,986,776 A 1/1991 Hensel et al.
5,050,461 A 9/1991 Onoue et al.
5,827,150 A 10/1998 Mukumoto
5,853,306 A 12/1998 Worth et al.
6,273,771 B1 8/2001 Buckley et al.
6,544,083 B1 4/2003 Sawyer et al.
6,692,320 B1 2/2004 Sawyer
6,929,518 B1 8/2005 Sawyer et al.
6,942,530 B1 * 9/2005 Hall et al. ..... 440/1
7,214,164 B2 5/2007 Shomura et al.
2003/0148851 A1 * 8/2003 Koerner et al. ..... 477/109
2006/0135314 A1 * 6/2006 Shomura et al. ..... 477/109

* cited by examiner

*Primary Examiner* — Jelani Smith
(74) *Attorney, Agent, or Firm* — Andrus Intellectual Property Law, LLP

(57) ABSTRACT

Systems and methods are for facilitating shift changes in a marine propulsion device. The systems comprise an internal combustion engine; a shift linkage that operatively connects a shift lever to a transmission for effecting shift changes amongst a reverse gear, a neutral gear and a forward gear; a speed sensor that senses current speed of the engine; and a control circuit that controls the engine to provide a reduction in speed of the engine to facilitate a shift change. The control circuit compares the current speed of the engine to a stored threshold speed and waits to invoke a reduction in speed of the engine until the current speed of the engine reaches the stored threshold speed.

13 Claims, 7 Drawing Sheets

SYSTEMS AND METHODS FOR FACILITATING SHIFT CHANGES IN MARINE PROPULSION DEVICES

CROSS-REFERENCE TO RELATED APPLICATION

The present application claims the benefit of and priority to U.S. Provisional Patent Application Ser. No. 61/782,485, filed Mar. 14, 2013, which is incorporated herein by reference in entirety.

FIELD

The present disclosure relates to marine propulsion devices, and more particularly to systems and methods for facilitating shift changes in marine propulsion devices.

BACKGROUND

The following US Patents and Applications provide background information and are incorporated herein by reference in entirety.

U.S. Pat. No. 4,753,618 discloses a shift cable assembly for a marine drive that includes a shift plate, a shift lever pivotally mounted on the plate, and a switch actuating arm pivotally mounted on the plate between a first neutral position and a second switch actuating position. A control cable and drive cable interconnect the shift lever and switching actuating arm with a remote control and clutch and gear assembly for the marine drive so that shifting of the remote control by a boat operator moves the cables to pivot the shift lever and switch actuating arm which in turn actuates a shift interrupter switch mounted on the plate to momentarily interrupt ignition of the drive unit to permit easier shifting into forward, neutral and reverse gears. A spring biases the arm into its neutral position and the arm includes an improved mounting for retaining the spring in its proper location on the arm.

U.S. Pat. No. 4,952,181 discloses a shift cable assembly for a marine drive having a clutch and gear assembly, including a remote control for selectively positioning the clutch and gear assembly into forward, neutral and reverse, a control cable connecting the remote control to a shift lever pivotally mounted on a shift plate, a drive cable connecting the shift lever on the shift plate to the clutch and gear assembly, and a spring guide assembly with compression springs biased to a loaded condition by movement of the remote control from neutral to forward and also biased to a loaded condition by movement of the remote control from neutral to reverse. The bias minimizes chatter of the clutch and gear assembly upon shifting into gear, and aids shifting out of gear and minimizes slow shifting out of gear and returns the remote control to neutral, all with minimum backlash of the cables. The spring guide assembly includes an outer tube mounted to the shift plate, and a spring biased plunger axially reciprocal in the outer tube and mounted at its outer end to the shift lever.

U.S. Pat. No. 4,986,776 discloses a shift speed equalizer in a marine transmission in a marine drive subject to a decrease in engine speed upon shifting from neutral to a forward or reverse gear due to a high propeller pitch or the like, such as in bass boat applications, and subject to an increase in engine speed upon shifting back to neutral. The shift from neutral to forward or reverse is sensed, and engine speed is increased in response thereto, to compensate the decrease in engine speed due to shifting. The return shift back to neutral is sensed, and engine speed is decreased in response thereto, to compensate the increase in engine speed due to shifting. Engine speed is increased by advancing engine spark ignition timing, and engine speed is decreased by retarding or returning engine ignition timing to its initial setting. Particular methodology and structure is disclosed, including modifications to an existing shift plate and to an existing guide block to enable the noted functions, and including the addition of an auxiliary circuit to existing ignition circuitry enabling the desired altering of engine ignition timing to keep engine speed from dropping when shifting into forward or reverse.

U.S. Pat. No. 6,273,771 discloses a control system for a marine vessel that incorporates a marine propulsion system that can be attached to a marine vessel and connected in signal communication with a serial communication bus and a controller. A plurality of input devices and output devices are also connected in signal communication with the communication bus and a bus access manager, such as a CAN Kingdom network, is connected in signal communication with the controller to regulate the incorporation of additional devices to the plurality of devices in signal communication with the bus whereby the controller is connected in signal communication with each of the plurality of devices on the communication bus. The input and output devices can each transmit messages to the serial communication bus for receipt by other devices.

U.S. Pat. No. 6,544,083 discloses a gear shift mechanism in which a cam structure comprises a protrusion that is shaped to extend into a channel formed in a cam follower structure. The cam follower structure can be provided with first and second channels that allow the protrusion of the cam to be extended into either which accommodates both port and starboard shifting mechanisms. The cam surface formed on the protrusion of the cam moves in contact with a selected cam follower surface formed in the selected one of two alternative channels to cause the cam follower to move axially and to cause a clutch member to engage with either a first or second drive gear.

U.S. Pat. No. 6,929,518 discloses a shifting apparatus for a marine propulsion device that incorporates a magneto-elastic elastic sensor which responds to torque exerted on the shift shaft of the gear shift mechanism. The torque on the shift shaft induces stress which changes the magnetic characteristics of the shift shaft material and, in turn, allows the magneto-elastic sensor to provide appropriate output signals representative of the torque exerted on the shift shaft. This allows a microprocessor to respond to the onset of a shifting procedure rather than having to wait for actual physical movement of the components of the shifting device.

U.S. Pat. No. 6,942,530 discloses an engine control strategy for a marine propulsion system that selects a desired idle speed for use during a shift event based on boat speed and engine temperature. In order to change the engine operating speed to the desired idle speed during the shift event, ignition timing is altered and the status of an idle air control valve is changed. These changes to the ignition timing and the idle air control valve are made in order to achieve the desired engine idle speed during the shift event. The idle speed during the shift event is selected so that the impact shock and resulting noise of the shift event can be decreased without causing the engine to stall.

U.S. Pat. No. 7,214,164 discloses shift operation control system for an outboard motor, which is capable of reducing a load that is acting on a shift operation lever during a shift operation and a shock occurring during the shift operation, to thereby facilitate the shift operation. The shift operation by the shift operation lever is continuously detected by a shift position detector, and when an early stage of the shift operation from the forward position to the neutral position or from the reverse position to the neutral position is detected and at the same time the engine speed at the detection is not less than a predetermined value, engine output reduction control is carried out, and when the shift position detector detects that the shift position has been switched to the neutral position, the engine output reduction control is canceled.

U.S. patent application Ser. No. 13/462,570 discloses systems and methods for controlling shift in a marine propulsion device. A shift sensor outputs a position signal representing a current position of a shift linkage. A control circuit is programmed to identify an impending shift change when the position signal reaches a first threshold and an actual shift change when the position signal reaches a second threshold. The control circuit is programmed to enact one or more shift interrupt control strategies that facilitate the actual shift change when the position signal reaches the first threshold, and to actively modify the first threshold as a change in operation of the marine propulsion device occurs.

U.S. patent application Ser. No. 13/760,870 discloses a system and method for diagnosing a fault state of a shift linkage in a marine propulsion device. A control lever is movable towards at least one of a maximum reverse position and a maximum forward position. A shift linkage couples the control lever to a transmission, wherein movement of the control lever causes movement of the shift linkage that enacts a shift change in the transmission. A shift sensor outputs a position signal representing a current position of the shift linkage. A control circuit diagnoses a fault state of the shift linkage when after the shift change the position signal that is output by the shift sensor is outside of at least one range of position signals that is stored in the control circuit.

U.S. patent application Ser. No. 14/144,135 discloses methods and systems for facilitating shift changes in a marine propulsion device having an internal combustion engine and a shift linkage that operatively connects a shift control lever to a transmission for effecting shift changes amongst a reverse gear, a neutral gear and a forward gear. A position sensor senses position of the shift linkage. A speed sensor senses speed of the engine. A control circuit compares the speed of the engine to a stored engine speed and modifies, based upon the position of the shift linkage when the speed of the engine reaches the stored engine speed, a neutral state threshold that determines when the control circuit ceases reducing the speed of the engine to facilitate a shift change.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

In certain examples, methods are for facilitating shift changes in a marine propulsion device. The marine propulsion device has an internal combustion engine and a shift linkage that operatively connects a shift lever to a transmission for effecting the shift changes amongst a reverse gear, a neutral gear and a forward gear. The method comprises: determining that a reduction in speed of the engine is necessary to facilitate a shift change; sensing a current speed of the engine; comparing the current speed of the engine to a stored threshold speed; and waiting to invoke the reduction in speed of the engine if the current speed of the engine is above the stored threshold speed.

In certain other examples, systems are for facilitating shift changes in a marine propulsion device. The systems comprise an internal combustion engine; a shift linkage that operatively connects a shift lever to a transmission for effecting shift changes amongst a reverse gear, a neutral gear and a forward gear; a speed sensor that senses current speed of the engine; and a control circuit that controls the engine to provide a reduction in speed of the engine to facilitate a shift change. The control circuit compares the current speed of the engine to a stored threshold speed and waits to invoke a reduction in speed of the engine until the current speed of the engine reaches the stored threshold speed.

In certain other examples, methods for facilitating shift changes in a marine propulsion device comprise moving the shift lever towards the neutral gear from one of the reverse gear and the forward gear; indicating to a control circuit that a reduction in speed of the engine is necessary to facilitate a shift change; sensing a current speed of the engine; comparing, with the control circuit, the current speed of the engine to a stored threshold speed; waiting to invoke said reduction in speed of the engine if the current speed of the engine is above the stored threshold speed; and thereafter if the shift change has not yet occurred, invoking the reduction in speed of the engine once the current speed of the engine reaches the stored threshold speed.

Various other aspects and exemplary combinations for these examples are further described herein below.

BRIEF DESCRIPTION OF THE DRAWINGS

Examples of methods and systems for facilitating shift changes in marine propulsion devices are described with reference to the following figures. The same numbers are used throughout the figures to reference like features and components.

DETAILED DESCRIPTION OF THE DRAWINGS

In the present description, certain terms have been used for brevity, clearness and understanding. No unnecessary limitations are to be inferred therefrom beyond the requirement of the prior art because such terms are used for descriptive purposes only and are intended to be broadly construed. The different methods and systems described herein may be used alone or in combination with other methods and systems. Various equivalents, alternatives, and modifications are possible within the scope of the appended claims.

Figure 1:
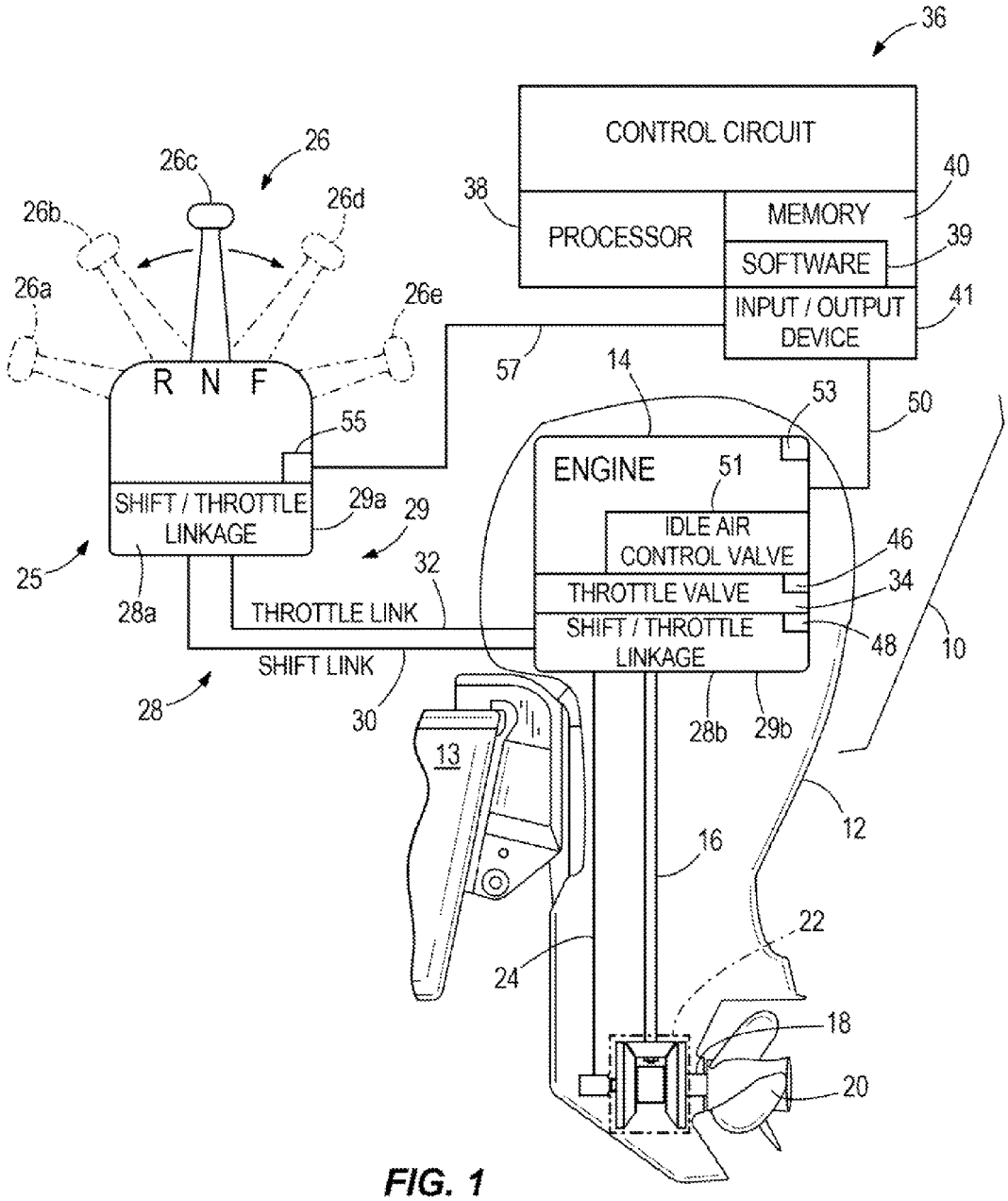
FIG. 1 is a schematic depiction of a shift control system for a marine propulsion device.

FIG. 1 depicts an exemplary shift control system 10 for a marine propulsion device 12 on a marine vessel 13. In the examples shown and described herein below, the marine propulsion device 12 is an outboard motor however the concepts of the present disclosure are not limited for use with outboard motors and can be implemented with other types of marine propulsion devices, such as inboard motors, sterndrives, hybrid electric marine propulsion systems, pod drives and/or the like. In the examples shown and described, the marine propulsion device 12 has an internal combustion engine 14 that causes rotation of a drive shaft 16 to thereby cause rotation of a propeller shaft 18. A propeller 20 is connected to and rotates with the propeller shaft 18 to propel the marine vessel 13 to which the marine propulsion device 12 is connected. The direction of rotation of propeller shaft 18 and propeller 20 is changeable by a transmission 22 having a clutch, which in the example shown is a conventional dog clutch; however many other types of clutches can instead or also be employed. As is conventional, the transmission 22 is actuated between forward gear, neutral gear and reverse gear by a shift rod 24.

The system 10 also includes a remote control 25 having an operator control lever 26, which in the example of FIG. 1 is a combination shift/throttle lever that is pivotally movable between a reverse wide open throttle position 26*a*, a reverse detent position (zero throttle) 26*b*, a neutral position 26*c*, a forward detent position (zero throttle) 26*d* and a forward wide open throttle position 26*e*, as is conventional. The remote control 25 typically is located remote from the marine propulsion device 12, for example at the helm of the marine vessel 13. The shift/throttle lever 26 is operably connected to a mechanical shift linkage 28 and a mechanical throttle linkage 29, such that pivoting movement of the shift/throttle lever 26 causes corresponding movement of the shift linkage 28 and such that pivoting movement of the shift/throttle lever 26 causes corresponding movement of the throttle linkage 29. Portions 28*a* of the shift linkage 28 are typically located at the remote control 25 and other portions 28*b* of the shift linkage 28 are located at the engine 14. Similarly, portions 29*a* of the throttle linkage 29 are typically located at the remote control 25 and other portions 29*b* of the throttle linkage 29 are located at the engine 14. The shift linkage 28 also includes a shift link 30 that translates movement of the shift/throttle lever 26 to the marine propulsion device 12, and ultimately to the shift rod 24, for causing a shift event (i.e. a change in gear) in the transmission 22. The shift link 30 can be for example a cable, rod, and/or the like. The throttle linkage 29 includes a throttle link 32 that translates movement of the shift/throttle lever 26 to the engine 14 of the marine propulsion device 12, and ultimately to change the position of a throttle valve 34 of the engine 14. The throttle link 32 can be for example a cable, rod, and/or the like.

The system 10 also includes a control circuit 36 that is programmable and includes a computer processor 38, software 39, a memory (i.e. computer storage) 40 and an input/output (interface) device 41. The processor 38 loads and executes the software 39 from the memory 30. When executed, software 39 controls the system 10 to operate as described herein in further detail below. The processor 38 can comprise a microprocessor and other circuitry that retrieves and executes software 39 from memory 40. Processor 38 can be implemented within a single device but can also be distributed across multiple processing devices or sub-systems that cooperate in executing program instructions. Examples include general purpose central processing units, application specific processors, and logic devices, as well as any other type of processing device, combinations of processing devices, and/or variations thereof.

Thus, the control circuit 36 can be located anywhere in the system 10 and/or located remote from the system 10 and can communicate with various components of the marine vessel 13 via wired and/or wireless links, as will be explained further herein below. The control circuit 36 can have one or more microprocessors that are located together or remote from each other in the system 10 or remote from the system 10. The system 10 can include more than one control circuit 36. For example, the system 10 can have a control circuit 36 located at or near the shift/throttle lever 26 and can also have a control circuit 36 located at or near the marine propulsion device 12. Each control circuit 36 can have one or more control sections.

The memory 40 can include any storage media readable by processor 38, and capable of storing software 39. The memory 40 can include volatile and non-volatile, removable and non-removable media implemented in any method or technology for storage of information, such as computer readable instructions, data structures, program modules, or other data. Memory 40 can be implemented as a single storage device but may also be implemented across multiple storage devices or sub-systems. Memory 40 can further include additional elements, such as a controller, capable of communicating with the processor 38. Examples of storage media include random access memory, read-only memory, magnetic discs, optical discs, flash memory disks, virtual and non-virtual memory, magnetic sets, magnetic tape, magnetic disc storage or other magnetic storage devices, or any other medium which can be used to store the desired information and that may be accessed by an instruction execution system, as well as any combination of variation thereof, or any other type of storage media. In some implementations, the storage media can be a non-transitory storage media.

The input/output device 41 can include any one of a variety of conventional computer input/output interfaces for receiving electrical signals for input to the processor 38 and for sending electrical signals from the processor 38 to various components of the system 10.

The control circuit 36, via the input/output device 41, communicates with components of the marine propulsion device 12 via a communication link 50, which can be a wired or wireless link. As explained further herein below, the control circuit 36 is capable of monitoring and controlling operational characteristics of the marine propulsion device 12 by sending and/or receiving control signals via the link 50. Although the link 50 is shown as a single link, the term "link" can encompass one or a plurality of links that are each connected to one of more of the components of the system 10.

A throttle valve 34 is provided on the engine 14 and a throttle valve position sensor (throttle sensor) 46 senses the position of the throttle valve 34, which is movable between open and closed positions. The type of throttle sensor 46 can vary. In this example, the throttle sensor 46 generates and provides electrical signals to the control circuit 36 via the link 50 indicating the current position of the throttle valve 34, for example in terms of a percent opening of the throttle valve 34, with 100% open being a fully open position of the throttle valve 34 and 0% open being a fully closed position of the throttle valve 34. One example of a throttle sensor 46 can be a wiper-type sensor, which can be located on the body of the throttle valve 34 and is commercially available from Cooper Auto or Walbro.

A shift sensor 48 senses a current position of the shift linkage 28 and provides this information to the control circuit 36 via the link 50. The control circuit 36 communicates with the shift sensor 48 via the link 50, which can be a wired or wireless link. The type of shift sensor 48 can vary. In this example, the shift sensor 48 includes a potentiometer and an electronic converter, such as an analog to digital converter that outputs discrete analog to digital (ADC) counts that each represents a position of the shift linkage 28. Such potentiometer and electronic converter combinations are known in the art and commercially available for example from CTS Corporation.

An engine speed sensor 53 is provided on the engine 14 and senses speed (e.g. rotations per minute [RPM]) of the engine 14. The type and location of engine speed sensor 53 can vary and in one example is a Hall Effect or variable reluctance VR sensor located near the encoder ring of the engine 14. Such an engine speed sensor 53 is known in the art and commercially available for example from CTS Corporation or Delphi.

An inertial switch 55 is provided on the operator shift/throttle lever 26, optionally being connected to the shift linkage 28. The inertial switch being actuated based upon a resistance on the shift linkage. The type and location of the inertial switch 55 can vary and in one example is a potentiometer, which is commercially available for example from CTS Corporation.

Figure 2:
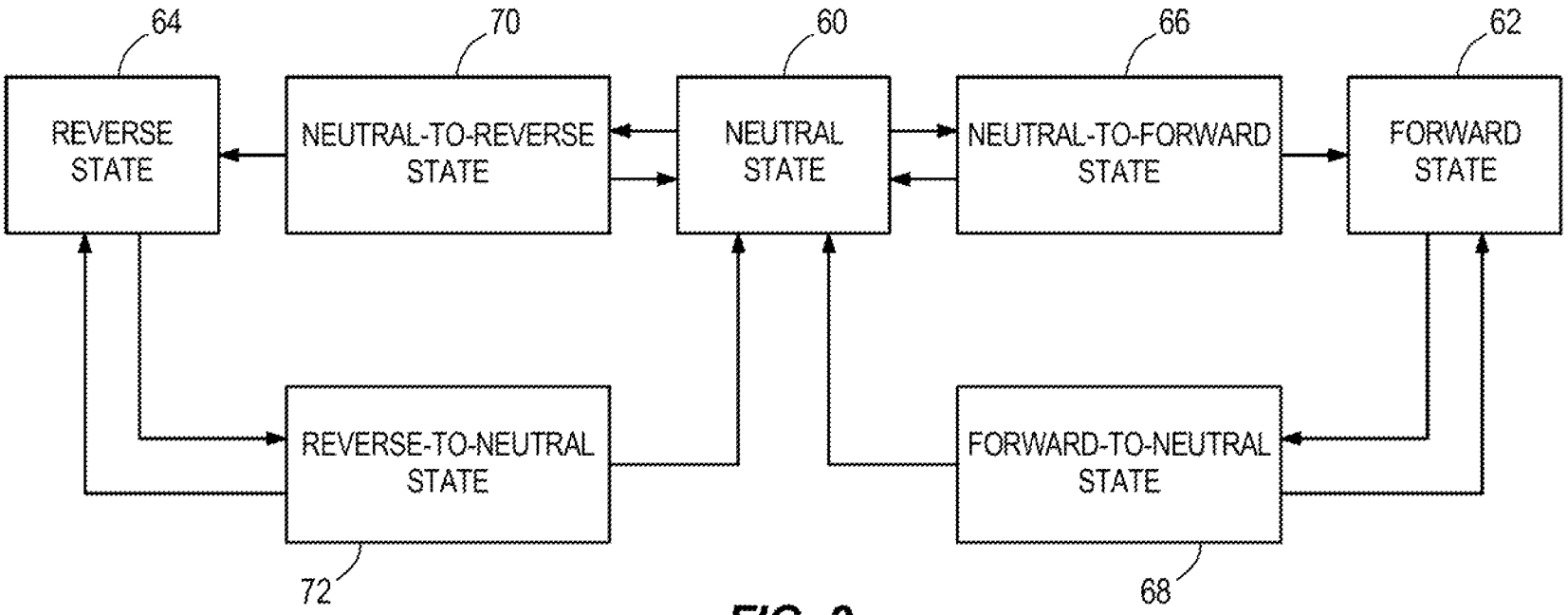
FIG. 2 is a state flow diagram depicting states of a shift control system for a marine propulsion device.

As mentioned herein above, the control circuit 36 is configured to monitor and control operational characteristics of the marine propulsion device 12 by sending and/or receiving control signals via the link 50. FIG. 2 is a stateflow diagram depicting several different operational modes or "control states" of the control circuit 36. In each control state, the control circuit 36 follows a protocol, as will be explained further herein below, to obtain a desired functional/operational output from the marine propulsion device 12 that is commensurate with operator inputs to the shift/throttle lever 26. In this example, the control circuit 36 is programmed to control the speed of the engine 14 based upon a current position of the shift/throttle lever 26 about its pivot axis. More specifically, as the shift/throttle lever 26 is pivoted, the shift sensor 48 outputs discrete ADC counts to the control circuit 36 based upon the position of the shift linkage 28. Each ADC count corresponds to a position of the shift/throttle lever 26 with respect to its pivot access. As will be explained further herein below, the control circuit 36 compares the current ADC count to a threshold and then controls that the engine 14 of the marine propulsion device 12 act according to a certain control state based upon the comparison, to thereby facilitate easier shifting by the marine propulsion device 12.

As described in the incorporated U.S. Pat. No. 6,942,530, shifting from one gear position to another gear position (such as from neutral gear to forward gear) can often result in significant impact noise and/or impact shock to the marine propulsion device, and particularly its drive components. This noise and/or shock results from the impact that occurs between moving parts of the clutch, for example. The amount of noise and/or shock is often proportional to the speed of the engine 14. The faster the speed of the engine 14, the more noise and/or shock, and vice versa. Shifting from one gear position to another gear position (such as from forward gear to neutral gear) can often cause a significant load to be placed on the shift mechanism. The faster the speed of the engine 14, the more load on the shift mechanism, and vice versa. During a shift event, it can therefore be desirable to briefly reduce the speed of the engine 14 in order to facilitate a shift event having less noise and/or shock and/or a shift event encountering reduced load. The speed of the engine 14 can be reduced by the control circuit 36 implementing one of several known "shift interrupt control strategies", several of which are disclosed in the above referenced U.S. Pat. No. 6,942,530, which are described in the context of reducing noise and/or shock. These shift interrupt control strategies can also be used to reduce the load. Shift interrupt control strategies can include for example controlling the engine 14 by varying spark ignition, varying engine torque profile, interrupting ignition, reducing engine torque, varying throttle valve position, interrupting engine ignition circuit, cutting fuel, opening the idle air control valve. The means by which these operational characteristics are implemented are well within the skill in the art. Implementing any one of these shift interrupt control strategies can cause the speed of the engine 14 to slow, thus decreasing the torque provided to the drive train, including the noted clutch.

The control circuit 36 is programmed to select and enact a shift interrupt control strategy (which briefly lowers the speed of the engine) when the position signal provided by the shift sensor 48 reaches a stored threshold. As explained in the above-referenced U.S. patent application Ser. Nos. 13/760,870; 13/760,870; and 14/144,135; advantageously, the control circuit 36 also can be programmed to actively modify one or more stored thresholds as a change in operation of the marine propulsion device 12 occurs, such as for example a change in a position of the throttle valve 34, as sensed by the throttle sensor 46.

As explained herein above, the control circuit 36 is programmed to compare the current position signal (here an ADC count) outputted by the shift sensor 48 to a threshold. When the position signal reaches the threshold, the control circuit 36 enacts a new control state. It should be understood that the control circuit 36 can follow generally the same protocol during a shift from neutral gear to reverse gear as it does during a shift from neutral gear to forward gear. Also, the control circuit 36 can follow generally the same protocol during a shift from reverse gear to neutral gear as it does during a shift from forward gear to neutral gear. As such, for discussion purposes and for brevity, an exemplary control circuit 36 protocol during a shift from neutral gear to forward gear, and back to neutral gear is discussed herein below with reference to FIGS. 2-4.

Referring to FIG. 2, the control circuit 36 is programmed with a threshold indicating a change from a Neutral State 60 to a Neutral-to-Forward State 66 in which the control circuit 36 can optionally be programmed to enact one or more shift interrupt control strategies, as defined herein above. The control circuit 36 can also be programmed with another threshold indicating a change from Neutral-to-Forward State 66 to Forward State 62, at which point the control circuit 36 can optionally be programmed to stop enacting the noted shift interrupt control strategies. The control circuit 36 is further programmed with another threshold indicating a change from the Forward State 62 to a Forward-to-Neutral State 68 during which state the control circuit 36 is programmed to enact one or more of the noted shift interrupt control strategies. The value of the threshold indicating a change from Forward State 62 to Forward-to-Neutral State 68 can be different than the value of the threshold indicating a change from Neutral-to-Forward State 66 to Forward State 62. The control circuit 36 is programmed with another threshold indicating a change from Forward-to-Neutral State 68 to the Neutral State 60, wherein the control circuit 36 is programmed to stop enacting the noted shift interrupt control strategies. As discussed above, this same type of protocol can apply in reverse, i.e. when a shift request is entered at the shift/throttle lever 26 for neutral to reverse shift and thereafter for reverse to neutral shift, wherein the control circuit 36 is programmed to employ a Neutral-to-Reverse State 70, Reverse State 64, and Reverse-to-Neutral State 72.

The system 10 is a mechanical system wherein manual inputs from the operator directly actuate the shift event. Thus the control circuit 36 has an observational role relative to the actual shifting event because the shifting event is largely controlled by mechanical connections in the marine propulsion device 12, including among other things the connections between the shift/throttle lever 26, throttle linkage 29, shift linkage 28, shift rod 24, and clutch. However the control circuit 36 can control characteristics of the engine 14 based upon the sensed operator inputs to the shift/throttle lever 26 and more specifically based upon sensed movements of the shift linkage 28, for example. In this example, mechanical tolerances and connections between the noted shift/throttle lever 26, shift linkage 28 (including portions 28*a*, 28*b* and shift link 30) will vary for each marine propulsion device 12. Because of this variability, the noted thresholds that are programmed in the control circuit 36 at the time the system 10 is initially configured, which thresholds typically represent common or estimated positions of the shift linkage 28 at which a shift event most likely occurs, will not necessarily accurately reflect such a result in every system. The difference between the thresholds that are programmed when the system 10 is initially configured and the actual positions at which changes in shift states occur can vary. For example, the position of the shift linkage 28, will not always accurately and/or precisely predict and/or represent the position at which an actual shift event occurs at the transmission 22. Each system will have slightly different physical characteristics, which causes the correlation between the position of the shift/throttle lever 26 and actuation of the clutch to vary and be unpredictable at the time of initial configuration of the system 10.

Figure 3:
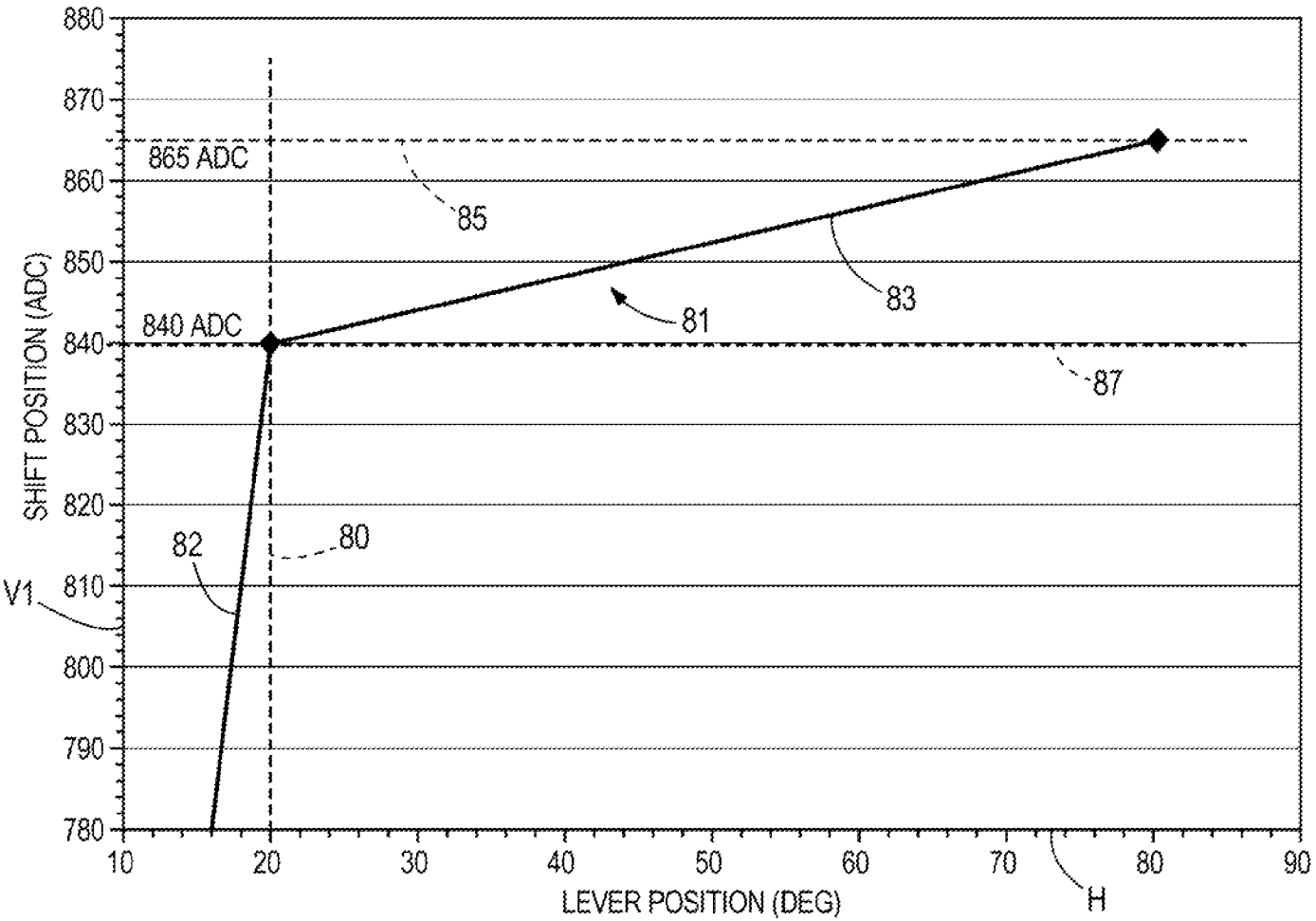
FIG. 3 is a graph depicting sensed movement of a shift linkage during a shift event.

FIG. 3 graphically depicts the above-described concepts in an exemplary shift linkage 28. The vertical axis V1 designates a range of analog to digital counts (ADC). The horizontal axis H designates a range of angular position of the shift/throttle lever 26 with respect to a vertical or neutral N position. Dashed line 80 designates the angle of the shift/throttle lever 26 at which a shift event actually occurs. In this example, the angle is twenty degrees. Solid line 81 designates the shift position signal (ADC) output by the shift sensor 48 as the shift/throttle lever 26 is pivoted about its axis. In this example, the shift position signal is 840 ADC when the actual shift event occurs at the noted twenty degrees. Dashed horizontal line 85 represents an ADC count at which the shift linkage 28 stops moving. Dashed horizontal line 87 designates the position signal (here, 840 ADC) output by the shift sensor 48 when the actual shift event occurs. The line 81 thus has a first portion 82 that shows the shift position signal (ADC) up until when the actual shift event occurs at twenty degrees. The line 81 also has a second portion 83 that shows changes in the shift position signal (ADC) after the actual shift event occurs. Second portion 83 thus illustrates additional movement of the shift linkage 28 after the actual shift event has occurred. This is movement is lost or wasted motion in the mechanical system. More particularly, the second portion 83 illustrates lost motion in the shift linkage 28 (including the associated shift link 30) that occurs during movement of the shift/throttle lever 26 from the forward detent position 26*d* to the forward wide open throttle position 26*e*. This motion of the shift linkage 28 does not impact or otherwise accurately predict the timing of the actual shift event. The slope and magnitude of second portion 83 will vary depending upon the particular marine propulsion device and depending upon the particular thresholds that are selected, for example when the system 10 is configured and the particular physical characteristics of the shift linkage 28.

Figure 4:
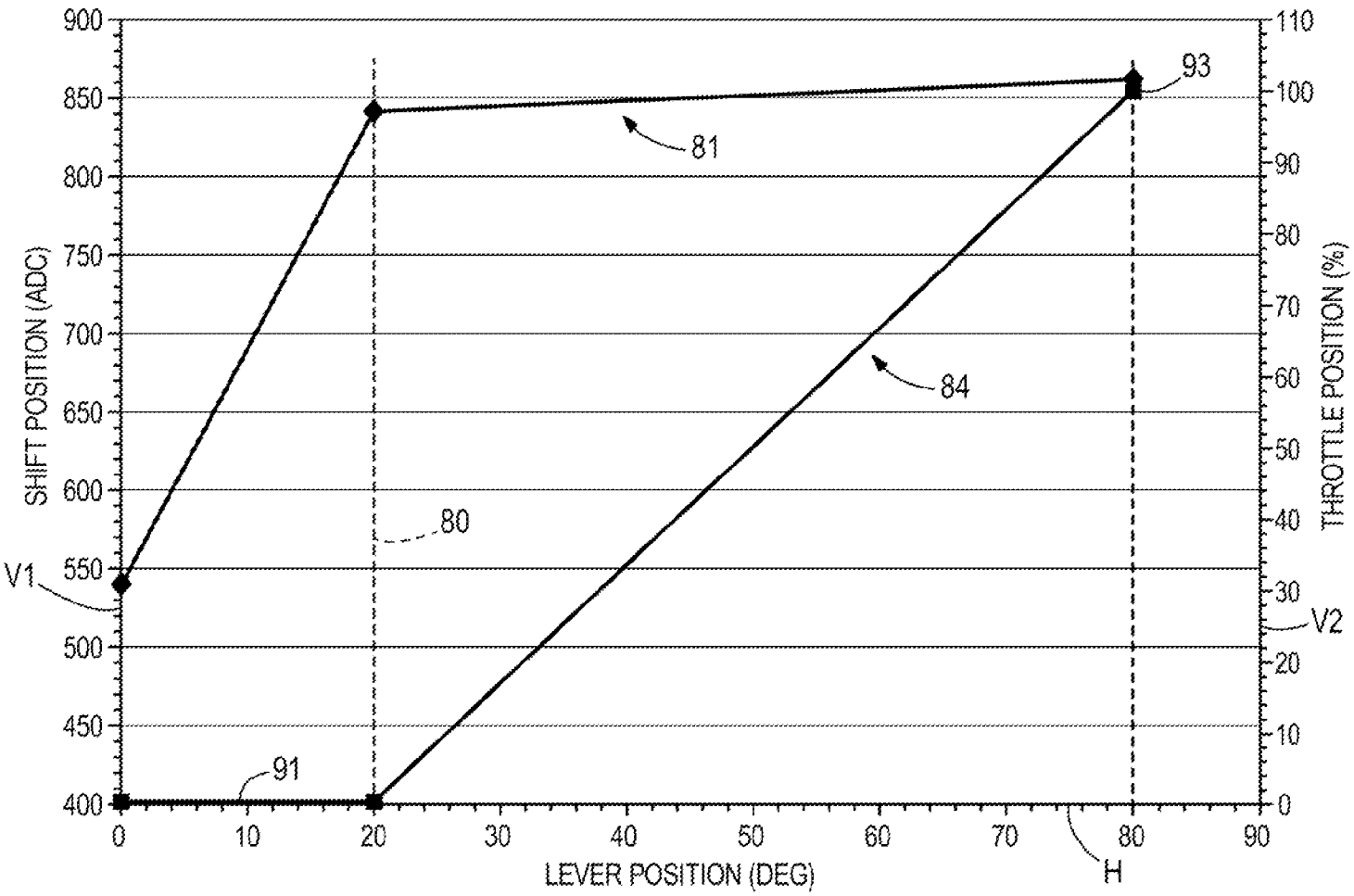
FIG. 4 is a graph depicting sensed movement of a shift linkage and a throttle linkage during a shift event.

Like FIG. 3. FIG. 4 depicts the shift position signal (solid line 81) that is output by the shift sensor 48. Line 84, FIG. 4, depicts the percent opening of the throttle valve 34 of the engine 14 during the movement of the shift/throttle lever 26. Vertical axis V2 indicates the percent opening of throttle valve 34. Once the actual shift event occurs at twenty degree lever position, the throttle valve 34 gradually opens from a closed throttle valve position at 91 to a fully open throttle valve position at 93.

Through research and development efforts, the present inventors have recognized that employing shift interrupt control strategies—such as varying spark ignition, varying engine torque profile, interrupting ignition, reducing engine torque, varying throttle valve position, interrupting engine ignition circuit, cutting fuel, opening the idle air control valve, etc.—at high engine speeds can be potentially harmful to the engine 14 and can also negatively affect the way in which the engine 14 ramps down to idle speed, thus causing instability and a potential for stalling when the shift/throttle lever 26 is quickly moved from forward or reverse gear to neutral gear. In addition, the inventors have found that, typically, the higher the engine speed, the less effective the shift interrupt control strategies.

Thus, advantageously, according to certain methods and systems of the present disclosure, implementation of the noted shift interrupt control strategies is delayed by the control circuit 36 until after the engine 14 achieves a "threshold speed" stored in the memory 40. The amount of the "threshold speed" can vary depending upon the particular system and in certain examples can be an amount that is calibrated based upon operational history and/or other characteristics of the system.

Figure 5:
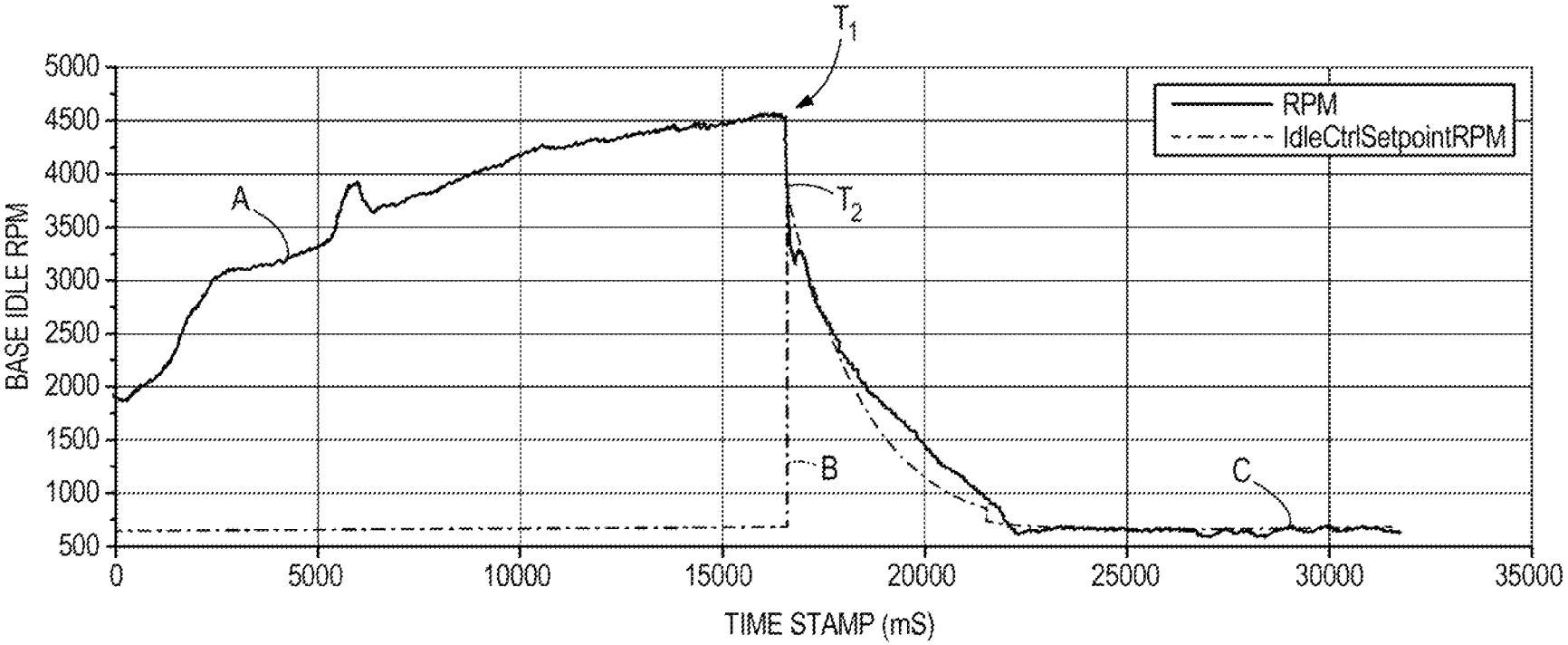
FIG. 5 is a graph depicting change in speed of an engine over time wherein a shift lever is moved from forward gear into neutral gear.

In one example, the noted threshold speed is a stored speed at which the control circuit 36 is programmed to begin controlling (i.e. ramping) speed of the engine 14 down to an idle set point speed at which the engine 14 is maintained in neutral gear. With reference to FIG. 5, Line A depicts speed (RPM) of the engine over time. Line B depicts an idle set point speed (RPM) that is stored in the control circuit 36. At time $T_1$, the speed of the engine 14 begins to rapidly decrease because of an operator rapidly moving the lever 26 from the forward wide open throttle position 26*f* to the neutral position 26*c*. Rapid movement of the shift/throttle lever 26 into the neutral position 26*c* moves the throttle linkage 29, which causes the throttle valve 34 to rapidly close, which in turn throttles the engine 14 and causes the speed of the engine 14 to rapidly decrease in the manner shown. This is sometimes referred to in the art as a "throttle chop". At a later time T2, in order to prevent stalling of the engine 14, the control circuit 36 is programmed to control an idle air control valve 51 on the engine 14 in a manner that transitions (i.e. ramps) the speed of the engine 14 down to the noted idle control set point speed, shown at C, without stalling or damage to the engine 14. Movement of the shift/throttle lever 26 at time T1 also causes movement of the shift linkage 28, which in some examples is sensed by the shift sensor 48 and communicated to the control circuit 36 via the link 50. As explained herein above, once the shift linkage 28 reaches the stored position threshold for the Forward-to-Neutral State 68, the control circuit 36 is programmed to determine that a shift interrupt control strategy is necessary to better facilitate a shift change from forward gear to neutral gear. In other examples, movement of the shift/throttle lever 26 at time T actuates the shift interrupt switch 55, which indicates to the control circuit 36 via link 57 that the shift interrupt control strategy is necessary to better facilitate the shift change from forward gear to neutral gear.

However in this example, contrary to the prior art, instead of immediately enacting the one or more shift interrupt control strategies once the position threshold of the Forward-to-Neutral State 68 is reached and/or the inertial switch 55 is actuated, the control circuit 36 is programmed to first compare the current speed of the engine 14 to a stored threshold speed in the memory 40. The control circuit 36 is programmed to wait to invoke the shift interrupt control strategies until the current speed of the engine 14 reaches the stored threshold speed. Once the current speed of the engine 14 reaches the stored threshold speed, the control circuit 36 is programmed to invoke the shift interrupt control strategies so as to reduce the speed of the engine 14 and facilitate the shift change. Preferably, the control circuit 36 is programmed to only enact the reduction in speed of the engine 14 if the shift change has not occurred already. That is, the control circuit 36 can be programmed to first determine whether the shift change has already occurred (based upon the position of the shift linkage 28 provided by the shift sensor 48 and position thresholds stored in the memory 40). If the stored threshold speed is reached and the shift change has not already occurred, the control circuit 36 can be programmed to enact the shift interrupt control strategies.

The present disclosure thus provides a system 10 for facilitating shift changes in a marine propulsion device 12. The system can comprise the engine 14; the shift linkage 28 that operatively connects a shift/throttle lever 26 to a transmission 22 for effecting shift changes amongst a reverse gear R, a neutral gear N, and a forward gear F; a speed sensor 51 that senses current speed of the engine 14; and the control circuit 36 that controls the engine 14 to provide a reduction in speed of the engine to facilitate a shift change. The control circuit 36 can be programmed to compare the current speed of the engine 14 to a stored threshold speed and wait to invoke a reduction in speed of the engine 14 until the current speed of the engine 14 reaches the stored threshold speed.

In certain examples, the control circuit 36 is programmed to invoke the reduction in speed of the engine 14 once the current speed of the engine 14 reaches the stored threshold speed and only if the shift change has not yet occurred. The reduction in speed of the engine 14 is invoked by employing one or more shift interrupt control strategies which can include for example controlling the engine 14 by varying the spark ignition, varying engine torque profile, interrupting ignition, reducing engine torque, varying throttle valve position, interrupting engine ignition circuit, cutting fuel, and opening an idle air control valve 15, and/or the like. The shift sensor 48 senses a current position of the shift linkage 28 and the control circuit 36 determines that the reduction in speed of the engine 14 is necessary once the current position of the shift linkage 28 reaches a stored position threshold. The throttle sensor 46 senses position of a throttle valve 34 on the engine 14 and the control circuit 36 further determines that the reduction in speed of the engine 14 is necessary once the throttle valve 34 closes by a stored amount. In other examples, an inertial switch 55 is actuated based upon a resistance from the shift linkage 28. The control circuit 36 determines that the reduction in speed of the engine 14 is necessary based upon actuation of the inertial switch 55. The stored threshold speed can include an idle entry threshold speed whereupon the control circuit 36 controls (ramps) speed of the engine 14 down to a stored idle set point speed by for example controlling the idle air control valve 51 and/or timing of spark in the engine 14, and/or the like.

Figure 6:
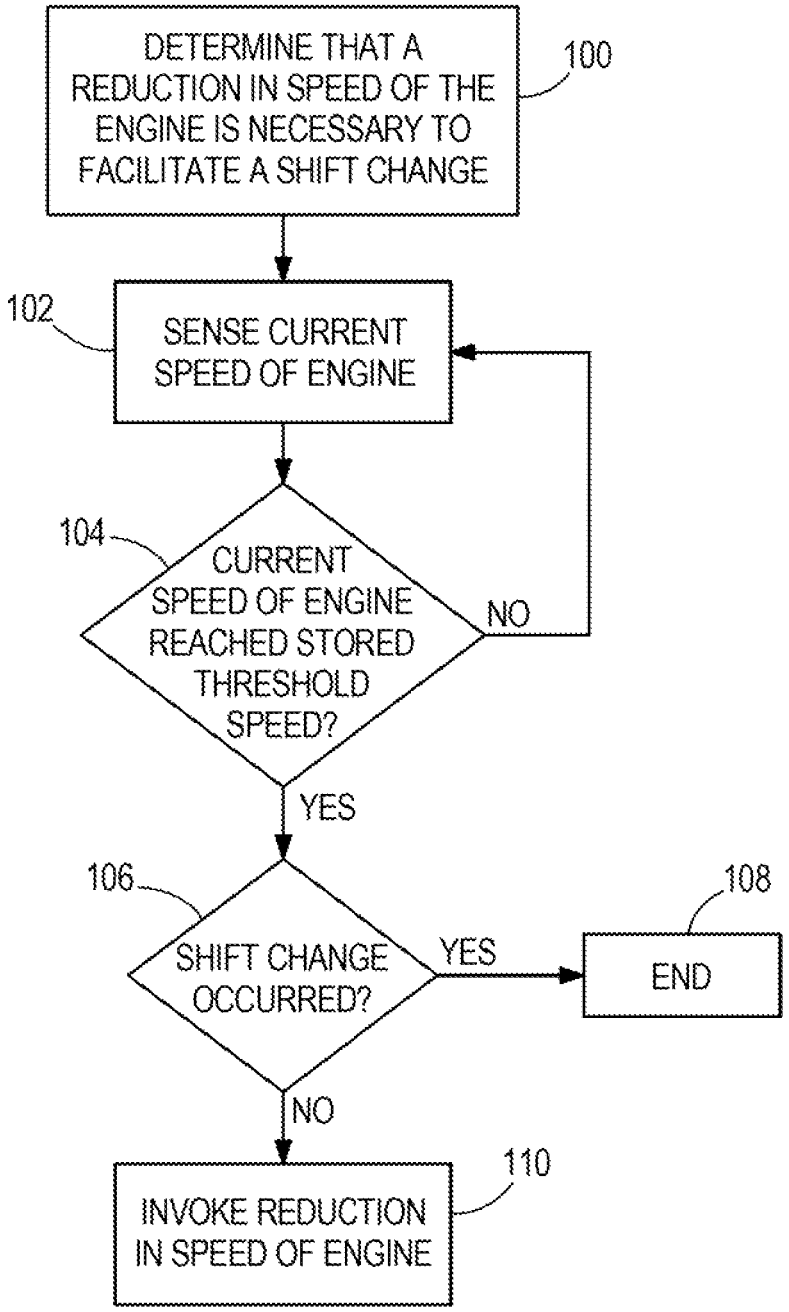
FIG. 6 is a flow chart depicting steps in one example of a method of controlling shift in a marine propulsion device.

Referring to FIG. 6, one example of a method of facilitating shift changes in the marine propulsion device 12 according to the present disclosure is provided. At step 100, the control circuit 36 determines that a reduction in speed of the engine 14 is necessary to facilitate a shift change. The control circuit 36 can make this determination based upon the position of the shift linkage 28, as communicated by the shift sensor 48, the position of the throttle valve 34, as communicated by the throttle sensor 46, and/or actuation of an inertial switch 55, as communicated by the link 57. At step 102, the speed sensor 53 senses the current speed of the engine 14 and communicates this information to the control circuit 36 via the link 50. At step 104, the control circuit 36 compares the current speed of the engine 14 to the stored threshold speed—which in certain examples can be a speed at which the control circuit 36 controls speed of the engine 14 down to the idle speed—to determine whether the current speed of the engine 14 has reached the stored threshold speed. If no, the method returns to step 102. If yes, at step 106, the control circuit 36 determines whether an actual shift change has occurred in the transmission 22. As discussed above, this can be accomplished by the control circuit 36 monitoring the position of the shift linkage 28 via the shift sensor 48. If yes, at step 108, the control circuit 36 aborts enactment of the reduction in speed of the engine 14 via shift interrupt control strategies since the shift change has already occurred. If no, at step 110, the control circuit 36 controls the engine 14 to invoke the reduction in speed of the engine 14 via one or more of the noted shift interrupt control strategies.

Figure 7:
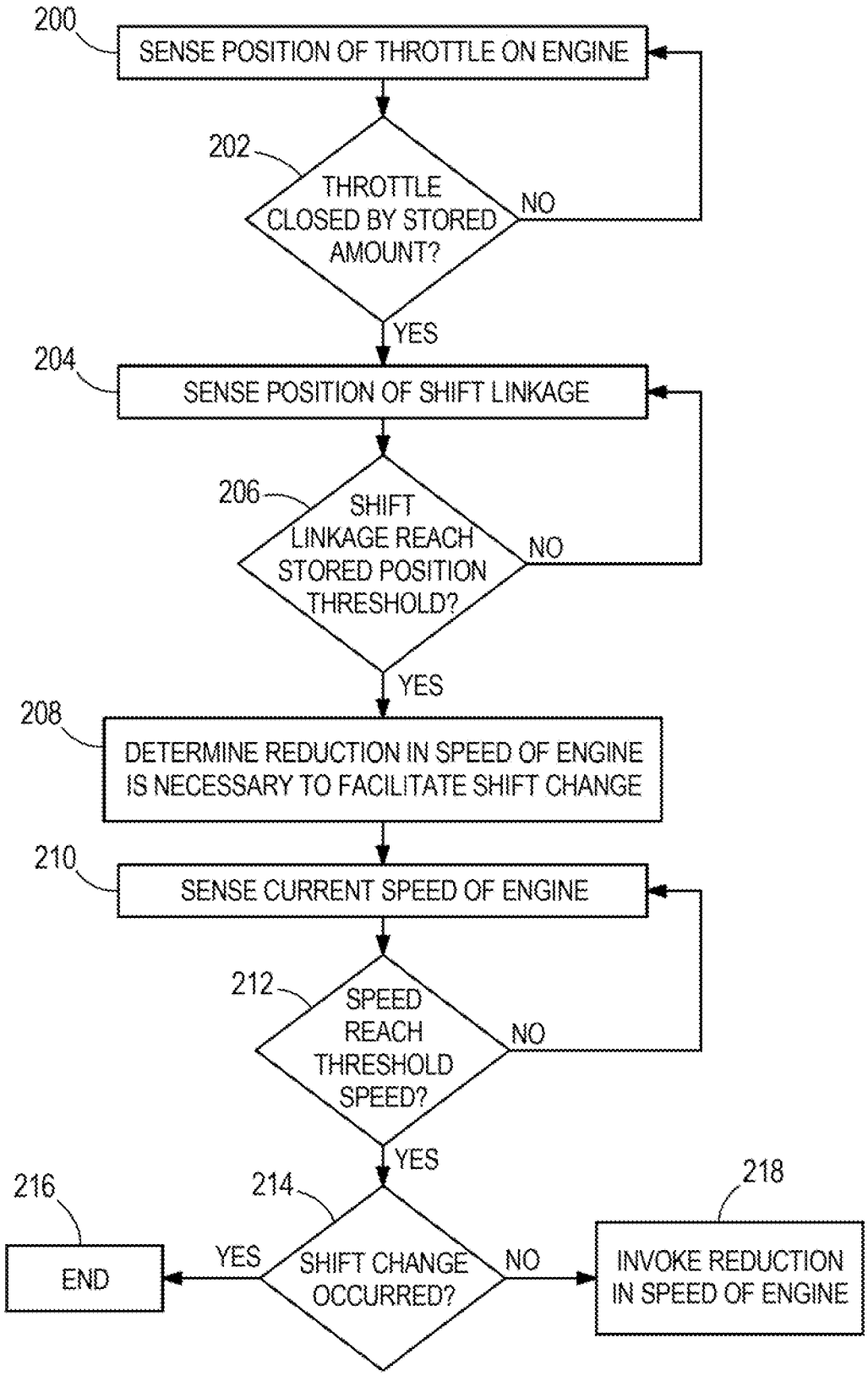
FIG. 7 is a flow chart depicting steps in another example of a method of controlling shift in a marine propulsion device.

FIG. 7 depicts another example of a method of facilitating shift changes in a marine propulsion device 12. At step 200, the throttle sensor 46 senses the position of the throttle valve 34 on the engine 14. At step 202, the control circuit 36 determines whether the throttle valve 34 is closed by a stored amount (e.g. a stored % throttle opening amount). The current position of the throttle valve 34 is communicated to the control circuit 36 by the throttle sensor 46 via the link 50. The value of the stored amount (% throttle opening amount) can change and can be a calibrated amount. If no, the method returns to step 200. If yes, at step 204, the shift sensor 48 senses position of the shift linkage 28 and communicates same to the control circuit 36 via the link 50. At step 206, the control circuit 36 determines whether the shift linkage 28 has reached a stored position threshold, such as for example the above-noted threshold indicating movement from the forward to neutral state 68 to the neutral state 60. If no, the method returns to step 204. If yes, at step 208, the control circuit 36 determines that a reduction in speed of the engine 14 is necessary to facilitate a shift change. At step 210, the speed sensor 53 senses current speed of the engine 14 and communicates this information to the control circuit 36 via the link 50. At step 212, the control circuit 36 determines whether the speed of the engine 14 has reached a stored threshold speed. If no, the control circuit returns to step 210. If yes, at step 214, the control circuit 36 determines whether an actual shift change has occurred. If yes, at step 216, the control circuit 36 does not enact the shift interrupt control strategies because the shift change has already occurred. If no, at step 218, the control circuit 36 invokes the shift interrupt control strategies to reduce the speed of the engine 14 and facilitate the shift change.

The present disclosure thus provides a method of facilitating shift changes in the marine propulsion device 12 having the engine 14 and the shift linkage 28 that operatively connects the shift/throttle lever 26 to the transmission 22 for effecting shift changes amongst the reverse gear R, neutral gear N and forward gear F. The method can comprise (a) determining that a reduction in speed of the engine 14 is necessary to facilitate a shift change; (b) sensing a current speed of the engine 14; (c) comparing the current speed of the engine 14 to a stored threshold speed; and (d) waiting to invoke the reduction in speed of the engine 14 if the current speed of the engine 14 is above the stored threshold speed. The method can further comprise (e) invoking the reduction in speed of the engine 14 once the current speed of the engine 14 reaches the stored threshold speed; and (f) invoking the reduction in speed of the engine only if the shift change has not yet occurred. In certain examples, the control circuit 36 can determine that the reduction in speed of engine is necessary by sensing a position of the shift linkage 28 and determining that the reduction in speed of the engine 14 is necessary once the current position of the shift linkage 28 reaches a stored position threshold, and further sensing position of a throttle valve 34 on the engine 14 and determining that the reduction in speed of the engine 14 is necessary once the throttle valve 34 closes by a stored amount. In certain other examples, the step of determining that a reduction in speed of the engine 14 is necessary to facilitate a shift change can be accomplished by monitoring actuation of the inertial switch 55 that is connected to the shift linkage 28 and is actuated based upon a resistance of the shift linkage 28. The stored threshold speed can be an idle entry threshold speed whereupon speed of the engine 14 is ramped down to a stored idle set point speed. Ramping of the speed of the engine 14 down to the stored idle set point can be accomplished by controlling at least one of an idle air control valve 51 and/or timing of spark in the engine 14, and/or the like.

The examples described in FIGS. 6 and 7 refer to a shift action from forward gear to neutral gear. However, it will be understood by those having ordinary skilled in the art that the concepts of the present disclosure are equally applicable to a shift event from reverse gear to neutral gear.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims. Each limitation in the appended claims is intended to invoke interpretation under 35 U.S.C. §112(f), only if the terms "means for" or "step for" are explicitly recited in the respective limitation.

What is claimed is:

1. A method of facilitating shift changes in a marine propulsion device, the marine propulsion device having an internal combustion engine and a shift linkage that operatively connects a shift lever to a transmission for effecting the shift changes amongst a reverse gear, a neutral gear and a forward gear, the method comprising:

(a) determining that a reduction in speed of the internal combustion engine is necessary to facilitate an actual shift change;

(b) sensing a current speed of the internal combustion engine;

(c) comparing the current speed of the internal combustion engine to a stored threshold speed, wherein the stored threshold speed is an idle entry threshold speed at which the speed of the internal combustion engine is being ramped down to a stored idle set point speed by controlling at least one of an idle air control valve and a timing of spark in the internal combustion engine;

(d) waiting to invoke the reduction in speed of the internal combustion engine if the current speed of the internal combustion engine is above the stored threshold speed;

(e) invoking the reduction in speed of the internal combustion engine once the current speed of the internal combustion engine reaches the stored threshold speed; and (f) aborting step (e) if the actual shift change has already occurred.

2. The method according to claim 1, wherein the reduction in speed of the internal combustion engine is invoked by employing a shift interrupt control strategy selected from a group consisting of controlling the internal combustion engine by varying spark ignition, varying engine torque profile, interrupting ignition, reducing engine torque, varying throttle valve position, interrupting engine ignition circuit, cutting fuel, and opening an idle air control valve.

3. The method according to claim 1, wherein (a) comprises sensing a current position of the shift linkage and determining that said reduction in speed of the internal combustion engine is necessary once the current position of the shift linkage reaches a stored position threshold.

4. The method according to claim 3, wherein (a) further comprises sensing position of a throttle on the internal combustion engine and further determining that said reduction in speed of the internal combustion engine is necessary once the throttle closes by a stored amount.

5. The method according to claim 1, wherein (a) comprises monitoring actuation of an inertial switch that is connected to the shift linkage, the inertial switch being actuated based upon a resistance on the shift linkage.

6. The method according to claim 1, comprising ramping speed of the internal combustion engine down to the stored idle set point by controlling at least one of an idle air control valve and a timing of spark in the internal combustion engine.

7. A method of facilitating shift changes in a marine propulsion device, the marine propulsion device having an internal combustion engine and a shift linkage that operatively connects a shift lever to a transmission for effecting the shift changes amongst a reverse gear, a neutral gear and a forward gear, the method comprising:

moving the shift lever towards the neutral gear from one of the reverse gear and the forward gear;

indicating to a control circuit that a reduction in speed of the internal combustion engine is necessary to facilitate a shift change;

sensing a current speed of the internal combustion engine;

comparing, with the control circuit, the current speed of the internal combustion engine to a stored threshold speed, wherein the stored threshold speed is an idle entry threshold speed at which the speed of the internal combustion engine is being ramped down to a stored idle set point speed by controlling at least one of an idle air control valve and timing of spark in the internal combustion engine;

waiting to invoke said reduction in speed of the internal combustion engine if the current speed of the internal combustion engine is above the stored threshold speed; and thereafter determining that the shift change has not yet occurred and then aborting the reduction in speed of the internal combustion engine if the actual shift change has already occurred.

8. A system for facilitating shift changes in a marine propulsion device, the system comprising:

an internal combustion engine;

a shift linkage that operatively connects a shift lever to a transmission for effecting shift changes amongst a reverse gear, a neutral gear and a forward gear;

a speed sensor that senses current speed of the internal combustion engine; and a control circuit that controls the internal combustion engine to provide a reduction in speed of the internal combustion engine to facilitate a shift change;

wherein the control circuit compares the current speed of the internal combustion engine to a stored threshold speed, wherein the stored threshold speed is an idle entry threshold speed at which the speed of the internal combustion engine is being ramped down to a stored idle set point speed by controlling at least one of an idle air control valve and timing of spark in the internal combustion engine;

wherein the control circuit waits to invoke a reduction in speed of the internal combustion engine until the current speed of the internal combustion engine reaches the stored threshold speed;

wherein the control circuit invokes the reduction in speed of the internal combustion engine once the current speed of the internal combustion engine reaches the stored threshold speed;

wherein the control circuit thereafter aborts any plan for the reduction in speed of the internal combustion engine if the shift change has already occurred.

9. The system according to claim 8, wherein the reduction in speed of the internal combustion engine is invoked by employing a shift interrupt control strategy selected from a group consisting of controlling the internal combustion engine by varying spark ignition, varying engine torque profile, interrupting ignition, reducing engine torque, varying throttle valve position, interrupting engine ignition circuit, cutting fuel, and opening an idle air control valve.

10. The system according to claim 8, comprising a position sensor that senses a current position of the shift linkage, wherein the control circuit determines that said reduction in speed of the internal combustion engine is necessary once the current position of the shift linkage reaches a stored position threshold.

11. The system according to claim 10, comprising a throttle sensor that senses position of a throttle on the internal combustion engine, and wherein the control circuit further determines that said reduction in speed of the internal combustion engine is necessary once the throttle closes by a stored amount.

12. The system according to claim 8, comprising an inertial switch that is actuated based upon a resistance on the shift linkage; wherein the control circuit determines that said reduction of speed of the internal combustion engine is necessary based upon actuation of the inertial switch.

13. The system according to claim 8, wherein the position sensor is a potentiometer and the marine propulsion device comprises an outboard motor.

* * * * *